United States Patent [19]

Morris

[11] Patent Number: 5,058,650

[45] Date of Patent: Oct. 22, 1991

[54] CORD EQUALIZER FOR WINDOW SHADE LIFT CORDS

[75] Inventor: John E. Morris, Lake Mills, Wis.

[73] Assignee: Graber Industries, Inc., Middleton, Wis.

[21] Appl. No.: 674,139

[22] Filed: Mar. 25, 1991

[51] Int. Cl.[5] ..... E06B 9/38

[52] U.S. Cl. ..... 160/168.1; 160/178.1

[58] Field of Search ..... 160/178.1, 168.1; 24/136 R, 115 M, 114.5

[56] References Cited

U.S. PATENT DOCUMENTS

| | | | |
|---|---|---|---|
| 2,220,203 | 11/1940 | Branin . | |
| 3,238,290 | 1/1966 | Ruple | 24/136 R |
| 4,635,698 | 1/1987 | Anderson . | |
| 4,858,810 | 8/1989 | Intlekofer et al. | 24/136 R X |
| 4,967,824 | 11/1990 | Colson et al. . | |

*Primary Examiner*—Blair M. Johnson

*Attorney, Agent, or Firm*—Vernon J. Pillote

[57] ABSTRACT

A cord equalizer for gripping a plurality of lift cords in a window covering. The cord equalizer includes a molded first body member having an elongated channel extending from a lower to an upper end, and a second body member overlying the channel and having a rib intermediate its ends extending crosswise of the channel. The first and second body members are slidably interconnected for relative movement in a direction lengthwise of the channel and a notch extends inwardly from the upper end of the second body member in registry with the channel to provide a passage for lift cords that opens laterally of the channel.

6 Claims, 1 Drawing Sheet

FIG.1
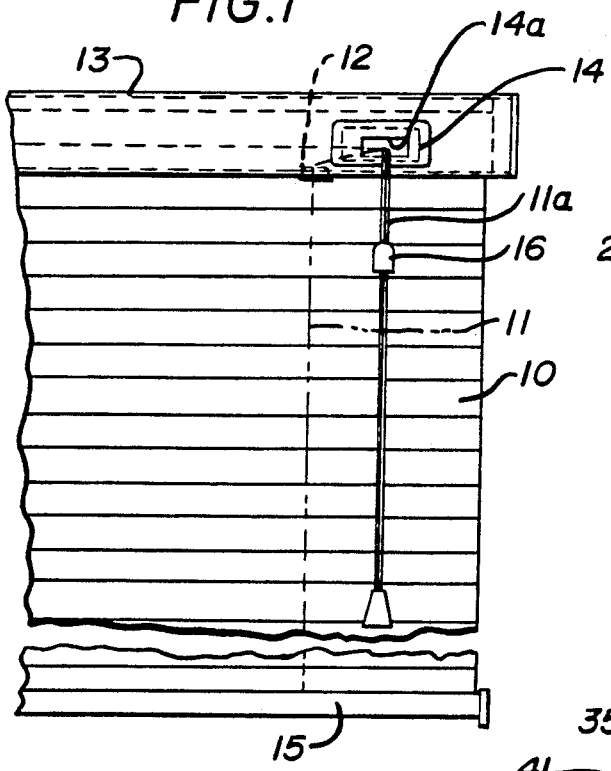
FIG. 2
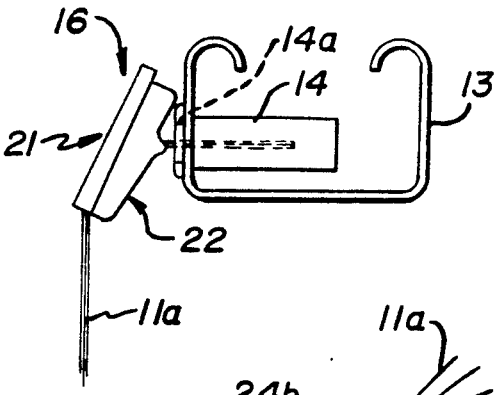
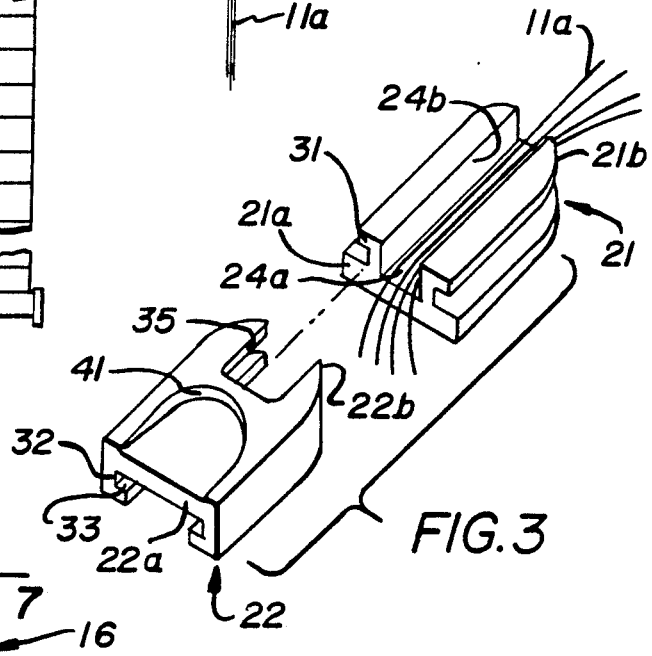
FIG.3
FIG.4
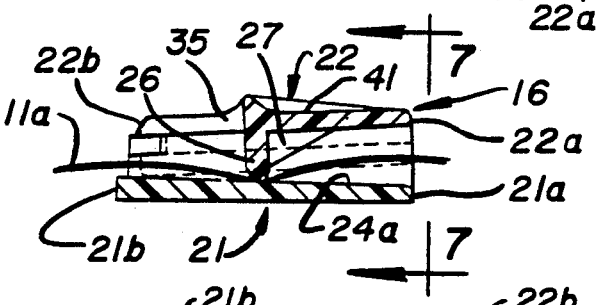
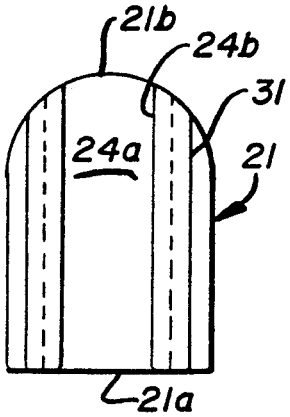
FIG.5
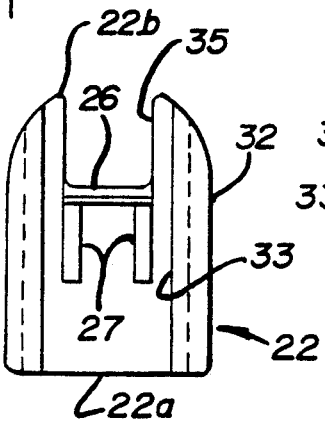
FIG.6
FIG.7
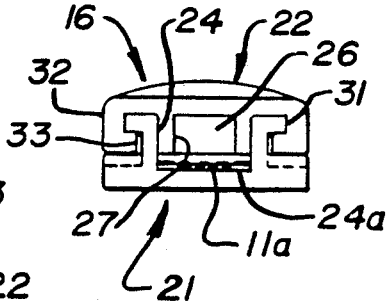

CORD EQUALIZER FOR WINDOW SHADE LIFT CORDS

BACKGROUND OF THE INVENTION

The invention relates to a cord equalizer for the lift cords of window shades of the type that are operated by simultaneous equal movement of two or more lift cords. The term window shade is used herein in its broad sense to include window coverings formed of fabric and pleated webs of material as well as slatted blinds and venetian blinds and which are operated by a plurality of lift cords.

Various cord equalizers have heretofore been made for equalizing movement of a plurality of lift cords in window shades and the like. The assignee of the present invention has heretofore made a lift cord equalizer having two body members hingedly connected along one edge by a thin flexible hinge portion, with ribs on the interfaces of the body members arranged to interleave and draw the lift cords into a sinus configuration, when the body members are closed and locked in position. U.S. Pat. No. 4,635,698 discloses a cord equalizer formed of two body members with a barb on one member arranged to press the cords into a sharp edged opening on a second body member, for the purpose of locking the lift cords to the cord equalizer. U.S. Pat. Nos. 2,220,203 and 4,967,824 illustrate clamp devices having slidably interconnected members for gripping cords and cables with a wedge type action.

SUMMARY OF THE INVENTION

The present invention provides a cord equalizer for gripping a plurality of lift cords of a window shade comprising molded first and second body members, the first body member having an elongated open channel extending from a lower to an upper end thereof and the second body member overlying the channel in the first body member and having rib means spaced from the upper end of the second body member and extending crosswise of the channel. The first and second body members have guide means outside the channel along opposite sides of the channel slidably interconnecting the body members for relative movement in a direction lengthwise of the channel, and at least a portion of the bottom wall of the channel is shaped to decrease the spacing between the guide means and the bottom of the channel to a minimum distance for gripping lift cords therebetween when the second body member is moved toward the upper end of the first body member. The second body member has a notch extending inwardly from the upper end between the guide means and registering with the channel to provide a passage for lift cords that opens laterally of the second body member.

BRIEF DESCRIPTION OF THE DRAWINGS

FIG. 1 is a fragmentary front view of a window shade having the cord equalizer of the present invention applied thereto;

FIG. 2 is an end view of the headrail of the window shade of FIG. 1;

FIG. 3 is an exploded perspective view of the cord equalizer;

FIG. 4 is a longitudinal sectional view of the cord equalizer showing the parts in an assembled condition;

FIG. 5 is a plan view illustrating the inner side of one of the body members;

FIG. 6 is a plan view illustrating the inner side of the other of the body members; and FIG. 7 is an end view taken on the plane 7—7 of FIG. 4.

DETAILED DESCRIPTION

Referring to FIG. 1, there is illustrated a window shade assembly comprising a window covering 10 having two or more lift cords 11 for raising and lowering the window covering. As is conventional, the lift cords 11 are attached to a bottom rail 15 of the window shade and extend upwardly and over cord guides 12 in a headrail 13. The lift cords extend lengthwise of the headrail and over a cord lock 14 adjacent one end of the headrail and then downwardly from the headrail with the several lift cords in closely spaced in generally parallel relation as shown at 11*a*. A cord equalizer 16 is attached to the downwardly extending portions of the lift cord to grip the several lift cords and lock the same to the equalizer so that the lift cords move in unison. The window shade 10 may be of various known types that are operated by a plurality of lift cords such as a pleated web of material; a "Roman" type shade; a slatted shade or Venetian blind, which window coverings are hereinafter sometimes referred to as a shade or curtain.

The cord equalizer 16 comprises molded first and second body members 21 and 22. The cord equalizer is disposed generally vertically when mounted on the downwardly extending portions 11*a* of the lift cords and body members 21 and 22 respectively have lower ends 21*a* and 22*a* and upper ends 21*b*, 22*b*. The first body member 21 has a cord receiving channel extending from the lower end 21*a* to the upper end 21*b*. The channel has a U-shaped cross section with a bottom wall 24*a* and spaced side walls 24*b* and the channel is open along its length at an inner side of the first body member. The second body member 22 overlies the open side of the channel in the first body member and has a rib 26 intermediate the upper and lower ends of the second body member that extends crosswise of the channel in the first body member and terminates in a cord engaging nose portion. As best shown in FIGS. 2 and 4, the rib 26 is reinforced by gussets 27 that are guidably received between the side walls 24*b* of the channel.

The first and second body members have guide means that slidably interconnect the body members for relative movement in a direction lengthwise of the channel. In the preferred embodiment illustrated, the guide means includes a pair of flanges 31 on the first body member that extends laterally outwardly from opposite side walls 24*b* of the channel, side wall portions 32 that extend along the outer edges of flanges 31 and a pair of flanges 33 on the second body member that extend inwardly into underlying relation with the flanges 31 on the first body member. As best shown in FIG. 4, the bottom wall 24*a* of the channel and the flanges 31 on the first body member are arranged so that they converge at a shallow angle in a direction from the lower to the upper end of the second body member to decrease the spacing between the nose portion of the rib 26 and the bottom of the channel to a minimum distance for gripping the lift cords therebetween when the second body member is moved toward the upper end of the first body member. The bottom wall 24*a* of the channel and the flanges 31 on the first body member may, for example, be arranged so that they converge toward each other in a direction from the lower to the upper ends at a shallow included angle of three or four degrees. The length of the rib 26 is preferably made such that the nose portion presses the lift cords into gripping engagement with the bottom wall of the channel when the upper end 22*b* of the second body member is spaced below the upper end 21*b* of the first body member as shown in FIG. 4.

In order to prevent crashing of the bottom rail of the shade against the window sill when the lift cords are released, the cord equalizers are sometimes positioned on the downwardly extending portion of the lift cords at a location such that they contact the cord lock 14 on the headrail before the bottom rail of the shade strikes the window sill. Some cord locks are mounted on the headrail with the cord opening at the under side of the headrail while some others open at the lower front corner of the headrail and still others open at the front of the headrail, as illustrated at 14*a* in FIGS. 1 and 2. The cord equalizer 16 is arranged so that the cord can extend from the upper end of the channel and also extend laterally outwardly from the open side of the channel intermediate the ends of the latter. For this purpose, a second body member 22 is formed with a notch 35 that extends inwardly from the upper end 22*b* and registers with the channel in the first body member to provide a passage for the lift cords 11*a* that opens laterally of the second body member. As shown in FIGS. 4 and 6, the notch preferably extends to a location adjacent the rib 26 on the second body member. With this arrangement, the cord equalizer will be normally positioned generally upright with the cords extending through the upper end of the channel when the cord equalizer is below the headrail. When the cord equalizer is used on headrails having the cord lock 14 opening at the front, for example as shown in FIGS. 1 and 2, the lift cords can pass laterally outwardly from the channel through the notch when the cord equalizer is raised to a position adjacent the cord lock 14, as shown in FIG. 2.

The cord equalizer is advantageously arranged so that the second body member can be moved into and out of gripping engagement with the cords by manipulation between the thumb and forefinger of the user's hand. As best shown in FIGS. 3 and 4, a thumb receiving depression 41 is formed in the outer face of the second body member at a location below the notch 35, to facilitate pushing the second body member into and out of its cord gripping position on the first body member.

The embodiments of the invention in which an exclusive property or privilege is claimed are defined as follows:

1. A cord equalizer for gripping a plurality of lift cords of a window shade comprising, molded first and second body members each having upper and lower ends, the first body member having an elongated open channel extending from the lower to the upper end thereof, the second body member overlying the channel in the first body member and having rib means spaced from the upper end of the second body and extending crosswise of the channel, the first and second body members having guide means outside the channel along opposite sides thereof slidably interconnecting the body members for relative movement in a direction lengthwise of the channel, at least a portion of the bottom wall of the channel being shaped to decrease the spacing betweeen the rib means and the bottom of the channel to a distance for gripping the lift cords when the second body member is moved toward the upper end of the first body member, the second body member having a notch extending inwardly from the upper end thereof and registering with the channel to provide a passage for lift cords opening laterally of the second body member.

2. A cord equalizer according to claim 1 wherein the notch extends to a location adjacent the rib means on the second body member.

3. A cord equalizer according to claim 1 wherein the guide means slidably interconnecting the first and second body members includes a pair of flanges on the first body member extending laterally outwardly along opposite sides of the channel and a pair of flanges on the second body member extending inwardly into underlying relation with the flanges on the first body member.

4. In a window covering having a headrail, a plurality of lift cords and lift cord guide means opening at a front side of the headrail, a cord equalizer for gripping a plurality of lift cords comprising, molded first and second body members, each having upper and lower ends, the first body member having an elongated open channel extending from the lower to the upper end thereof, the second body member overlying the channel in the first body member and having rib means spaced from the upper end of the second body member and extending crosswise of the channel, the first and second body members having guide means outside the channel along opposite sides thereof slidably interconnecting the body members for relative movement in a direction lengthwise of the channel, at least a portion of the bottom wall of the channel being shaped to decrease the spacing between the guide means and the bottom of the channel to a distance for gripping the lift cords when the second body member is moved toward the upper end of the first body member, the second body member having a notch extending inwardly from the upper end thereof and registering with the channel to provide a passage for lift cords opening laterally of the second body member.

5. A cord equalizer according to claim 4 wherein the notch extends to a location adjacent the rib means on the second body member.

6. A cord equalizer according to claim 4 wherein the means for slidably interconnecting the first and second body members includes a pair of flanges on the first body member extending outwardly along opposite sides of the channel and a pair of flanges on the second body member extending inwardly into underlying relation with the flanges on the first body member.

* * * * *